US011365502B2

(12) United States Patent
Colin et al.

(10) Patent No.: US 11,365,502 B2
(45) Date of Patent: Jun. 21, 2022

(54) LAUNDRY WASHING MACHINE

(71) Applicant: Electrolux Appliances Aktiebolag, Stockholm (SE)

(72) Inventors: Igor Colin, Porcia (IT); Marcin Lorenc, Porcia (IT); Diana Moruzzi, Porcia (IT); Ashish Gupta, Porcia (IT); Rukesh Narayanan K R, Porcia (IT)

(73) Assignee: Electrolux Appliances Aktiebolag

( * ) Notice: Subject to any disclaimer, the term of this patent is extended or adjusted under 35 U.S.C. 154(b) by 162 days.

(21) Appl. No.: 16/797,687

(22) Filed: Feb. 21, 2020

(65) Prior Publication Data

US 2020/0270799 A1 Aug. 27, 2020

(30) Foreign Application Priority Data

Feb. 26, 2019 (EP) ..... 19159502

(51) Int. Cl.

*D06F 37/22* (2006.01)
*D06F 23/02* (2006.01)
*D06F 37/24* (2006.01)

(52) U.S. Cl.

CPC ..... *D06F 37/22* (2013.01); *D06F 23/02* (2013.01); *D06F 37/225* (2013.01); *D06F 37/24* (2013.01); *D06F 37/245* (2013.01)

(58) Field of Classification Search

CPC ..... D06F 37/22; D06F 37/225; D06F 37/24; D06F 37/245; D06F 23/02

See application file for complete search history.

(56) References Cited

U.S. PATENT DOCUMENTS 5,850,749 A * 12/1998 Kim ..... D06F 37/225 68/23.2
5,857,361 A * 1/1999 Jang ..... D06F 37/225 68/23.2

(Continued)

FOREIGN PATENT DOCUMENTS

EP 0810317 A1 12/1997
EP 1862577 A2 12/2007

(Continued)

OTHER PUBLICATIONS

Extended European Search Report for European Application No. 19 159 502.4, dated Aug. 2, 2019, 7 pages.

(Continued)

*Primary Examiner* — Joseph L. Perrin
(74) *Attorney, Agent, or Firm* — RatnerPrestia

(57) ABSTRACT

A laundry washing machine having an outer casing, a washing tub, a rotatable drum and at least one balancing ring rigidly secured to the drum for reducing vibrations thereof. The balancing ring comprises an annular housing rigidly secured to the drum, an internal closed annular inner cavity, and balancing masses in free movable manner inside the annular inner cavity. The annular housing has first and second discrete and complementary annular hemishells that are joined to one another to form the annular inner cavity. The annular hemishells are substantially coplanar and concentric to one another, and have approximately C-shaped cross sections that are substantially complementary to one another. The hemishells are joined to one another along corresponding first and second mating annular rims, which are arranged on opposite sides of a given intermediate plane perpendicular to the central axis of the annular housing.

14 Claims, 4 Drawing Sheets

(56) References Cited

U.S. PATENT DOCUMENTS

| | | | | |
|---|---|---|---|---|
| 7,942,026 | B2 | 5/2011 | Ryu et al. | |
| 9,394,643 | B2 | 7/2016 | Malheiros et al. | |
| 2007/0283727 | A1 | 12/2007 | Kim et al. | |
| 2008/0110212 | A1 | 5/2008 | Kim et al. | |
| 2011/0162442 | A1 | 7/2011 | Ronlan et al. | |
| 2013/0086953 | A1 | 4/2013 | Choi et al. | |
| 2014/0208805 | A1* | 7/2014 | Jung | D06F 37/20 68/23.2 |
| 2015/0082837 | A1 | 3/2015 | Malheiros et al. | |
| 2015/0322613 | A1* | 11/2015 | Borlin | D06F 37/245 68/140 |
| 2015/0322614 | A1* | 11/2015 | Borlin | F16F 7/1034 188/378 |
| 2015/0322615 | A1* | 11/2015 | Borlin | D06F 37/225 68/140 |
| 2015/0345067 | A1 | 12/2015 | Erickson et al. | |
| 2018/0038034 | A1 | 2/2018 | Kwak et al. | |

FOREIGN PATENT DOCUMENTS

| | | | |
|---|---|---|---|
| EP | 2578738 | A1 | 4/2013 |
| KR | 20070115295 | A | 12/2007 |

OTHER PUBLICATIONS

Extended European Search Report for European Application No. 19 159 504.0, dated Aug. 2, 2019, 7 pages.
Non Final Office Action for U.S. Appl. No. 16/797,761, dated Nov. 1, 2021, 18 pages.

* cited by examiner

LAUNDRY WASHING MACHINE

This application claims priority to and the benefit of European Application No. EP 19159502.4, filed on Feb. 26, 2019, which is incorporated herein by reference.

FIELD OF THE INVENTION

The present invention relates to a laundry washing machine.

More in detail, the present invention relates to a front-loading home laundry washing machine, to which the following description specifically refers purely by way of example without this implying any loss of generality.

BACKGROUND OF THE INVENTION

As is known, a front-loading home laundry washing machine generally comprises: a substantially parallelepiped-shaped, self-supporting boxlike outer casing structured for resting on the floor; a substantially horizontally-oriented and nearly cylindrical, cup-shaped washing tub which, in use, contains the washing liquid and is suspended in floating manner inside the casing, with the front mouth directly facing a laundry loading-unloading through opening formed in the front wall of the casing; a substantially cylindrical, cup-shaped rotatable drum which is structured for accommodating the laundry to be washed, and is fitted in axially rotatable manner inside the washing tub with the concavity facing the laundry loading-unloading opening, so as to be able to freely rotate inside the washing tub about its substantially horizontally-oriented, central axis locally coinciding with the longitudinal axis of the washing tub; an elastically-deformable bellows which watertight connects the front mouth of the washing tub to the laundry loading-unloading opening formed in the front wall of the casing; a porthole door which is hinged to the front wall of the casing to rotate to and from a closing position in which the door closes the laundry loading-unloading opening in the front wall of the casing for watertight sealing the washing tub; and an electrically-powered motor assembly which is structured for driving into rotation the rotatable drum about its longitudinal axis inside the washing tub.

To reduce vibrations of the drum during spin phases with unbalance loads, today's high end laundry washing machines are additionally provided with at least one and usually two ball balancing rings which are rigidly secured to the drum body perfectly coaxial to the drum rotation axis.

More specifically, each ball balancing ring is substantially circular in shape and is usually secured to the drum body, outside of the drum and adjacent to the front or rear rim of the drum cylindrical wall, coaxial to the drum rotation axis.

Each ball balancing ring moreover basically comprises: a rigid, toroidal housing having inside a perfectly circular, closed annular inner cavity; and a number of heavy spherical masses accommodated in free movable manner inside the inner cavity of the toroidal housing together with a viscous liquid that damps out the movement of the spherical masses inside the inner cavity. The toroidal housing is secured to the drum body perfectly coaxial to the drum rotation axis, so that the annular inner cavity lies/extends on a plane perfectly perpendicular to the drum rotation axis.

During spin phases, the spherical masses tend to group together and to move altogether inside the inner cavity so as to balance the unbalanced load (laundry) momentarily placed inside the drum.

EP1862577 A2 discloses a front-loading laundry washing machine wherein the hollow toroidal housing of the ball balancing ring is divided into two discrete annular members that are made of plastic material and are fused together.

The first annular member has a nearly U-shaped cross section with the two opposite lateral walls extending nearly perpendicular to the midplane of the toroidal housing (i.e. the plane perpendicular to the central axis of the torus and containing the geometric barycenters of all the transversal/poloidal cross-sections of the torus), whereas the second annular member has a nearly plate-like annular structure and is arranged to close the upper annular opening of the circular groove delimited by the first annular member.

More in detail the second annular member extends parallel to the midplane of the toroidal housing, is arranged in abutment against the inner and outer annular rims/edges of the first annular member, and is stably welded to the first annular member without interruptions along the same inner and outer annular rims/edges of the first annular member.

The main drawback of this structure is that, during spin phases, the spherical masses group together and altogether continuously roll on the outer cylindrical lateral wall of the first annular member highly stressing the area where the second annular member is welded to the first annular member, with all problems that this entails.

Experimental tests, in fact, revealed that, when drum rotation speed exceeds 1000 rpm, the centrifugal forces acting on the outer cylindrical lateral wall of the first annular member tend to concentrate on a very limited section of the lateral wall and, at same time, tend to move altogether on the lateral wall at a given angular speed, thus causing a concentrate mechanical stress that continuously travels/moves along the toroidal housing like a wave.

At relatively high rotation speeds, this concentrated mechanical stress becomes so high to locally bend/deform outwards the lateral wall of the first annular member enough to cause localized microcracks in the welding areas between first and second annular members. These microcracks, in the long run, tend to widen and cause the leakage of the viscous fluid contained into the inner cavity of the annular casing, thus preventing the ball balancing ring to correctly operate.

To avoid any leakage risk, the toroidal structure is usually highly oversized, with all problems that this entails in terms of overall dimensions and weight of the ball balancing ring. Oversizing additionally makes the welding process of the housing more complicated. A thicker annular wall, in fact, implies more plastic material to be fused during the welding process and a higher risks of the welding residues to arrive inside the annular inner cavity.

SUMMARY OF THE INVENTION

Aim of the present invention is to realize a ball balancing ring easier to be produced and capable of operating at high drum rotation speeds without long-term structural problems.

In compliance with the above aims, according to the present invention there is provided a laundry washing machine having an outer casing and comprising, inside said outer casing: a washing tub adapted to contain the washing liquid; a rotatable drum which is fitted in axially rotatable manner inside the washing tub and is adapted to contain the laundry to be washed; and at least one balancing ring which is rigidly secured to the rotatable drum for reducing the vibrations of the drum;

said at least one balancing ring comprising: a substantially toroidal, annular housing which is rigidly secured to the drum and is provided with a closed annular inner cavity; and a number of balancing masses accommodated in free movable manner inside said annular inner cavity;

the annular housing including a first and a second discrete and complementary annular hemishells which are joined to one another so as to form/delimit the annular inner cavity of said annular housing;

the laundry washing machine being characterized in that said first and second annular hemishells are substantially concentric to one another, have approximately C-shaped cross sections complementary to one another, and are stably joined/coupled to one another along corresponding first and second mating annular rims/edges which are arranged on opposite sides of a given intermediate plane perpendicular to the central axis of said annular housing.

Preferably, though not necessarily, the laundry washing machine is furthermore characterized in that said first and second annular hemishells are substantially coplanar to one another.

Preferably, though not necessarily, the laundry washing machine is furthermore characterized in that the axis around which the drum rotates is horizontal, or slightly inclined, with respect to the plane where the machine rests in its working position.

Preferably, though not necessarily, the laundry washing machine is furthermore characterized in that the first and second annular rims/edges of the first annular hemishell and the first and second annular rims/edges of the second annular hemishell are located on a same frustoconical surface which is coaxial to the central axis of the annular housing and has an opening angle lower than 150°.

Preferably, though not necessarily, the laundry washing machine is furthermore characterized in that the opening angle of said frustoconical surface ranges between 20° and 70°.

Preferably, though not necessarily, the laundry washing machine is furthermore characterized in that the opening angle of said frustoconical surface is equal to about 30°.

Preferably, though not necessarily, the laundry washing machine is furthermore characterized in that the approximately C-shaped cross section of both said first and said second annular hemishells has a curved polygonal-chain profile, so that the annular inner cavity of said hollow annular housing has a substantially polygonal-shaped cross section.

Preferably, though not necessarily, the laundry washing machine is furthermore characterized in that the annular inner cavity of said hollow annular housing has a nearly hexagonal cross section.

Preferably, though not necessarily, the laundry washing machine is furthermore characterized in that the first annular hemishell has a first wall segment and a second wall segment nearly faced and non-parallel to one another, and a third wall segment connecting the first wall segment to the second wall segment; the first annular rim/edge of the first annular hemishell edging the first wall segment of said first annular hemishell; the second annular rim/edge of the first annular hemishell edging the second wall segment of said first annular hemishell.

Preferably, though not necessarily, the laundry washing machine is furthermore characterized in that the second annular hemishell has a first wall segment and a second wall segment nearly faced and non-parallel to one another, and a third wall segment connecting the first wall segment to the second wall segment; the first annular rim/edge of the second annular hemishell edging the first wall segment of said second annular hemishell; the second annular rim/edge of the second annular hemishell edging the second wall segment of said second annular hemishell.

Preferably, though not necessarily, the laundry washing machine is furthermore characterized in that the second annular hemishell surrounds the first annular hemishell and is adapted to firmly abut on the drum.

Preferably, though not necessarily, the laundry washing machine is furthermore characterized in that the second annular hemishell is provided with a number of fixing protrusions which are angularly spaced about the central axis of the second annular hemishell and extend outwards in a nearly radial direction so as to stably abut against the drum.

Preferably, though not necessarily, the laundry washing machine is furthermore characterized in that said first and second annular hemishells are made of plastic material.

Preferably, though not necessarily, the laundry washing machine is furthermore characterized in that the first and second annular rims/edges of the first annular hemishell are welded to the corresponding first and second annular rims/edges of the second annular hemishell.

Preferably, though not necessarily, the laundry washing machine is furthermore characterized in that the first and second annular rims/edges of said first annular hemishell are joined to the corresponding first and second annular rims/edges of the second annular hemishell by gluing.

Preferably, though not necessarily, the laundry washing machine is furthermore characterized in that the balancing ring is rigidly secured directly to the cylindrical wall of the drum.

Preferably, though not necessarily, the laundry washing machine is furthermore characterized in that the balancing ring is located inside the drum.

Preferably, though not necessarily, the laundry washing machine is furthermore characterized in that the balancing ring includes, inside the annular inner cavity, a dumping liquid that damps out the movement of the balancing masses inside the same annular inner cavity.

Preferably, though not necessarily, the laundry washing machine is furthermore characterized in that the balancing masses are spherical in shape.

Preferably, though not necessarily, the laundry washing machine is furthermore characterized in that said intermediate plane substantially coincides with the midplane of said annular housing.

Preferably, though not necessarily, the laundry washing machine is furthermore characterized in that both said first and second annular hemishells extend astride of the midplane of said annular housing.

BRIEF DESCRIPTION OF THE DRAWINGS

A non-limiting embodiment of the present invention will now be described, by way of example, with reference to the accompanying drawings, in which:

FIG. 5 is an enlarged perspective view of a segment of the balancing ring shown in FIGS. 3 and 4, with parts removed for clarity; whereas

DETAILED DESCRIPTION OF EXEMPLARY EMBODIMENTS

Figure 1:
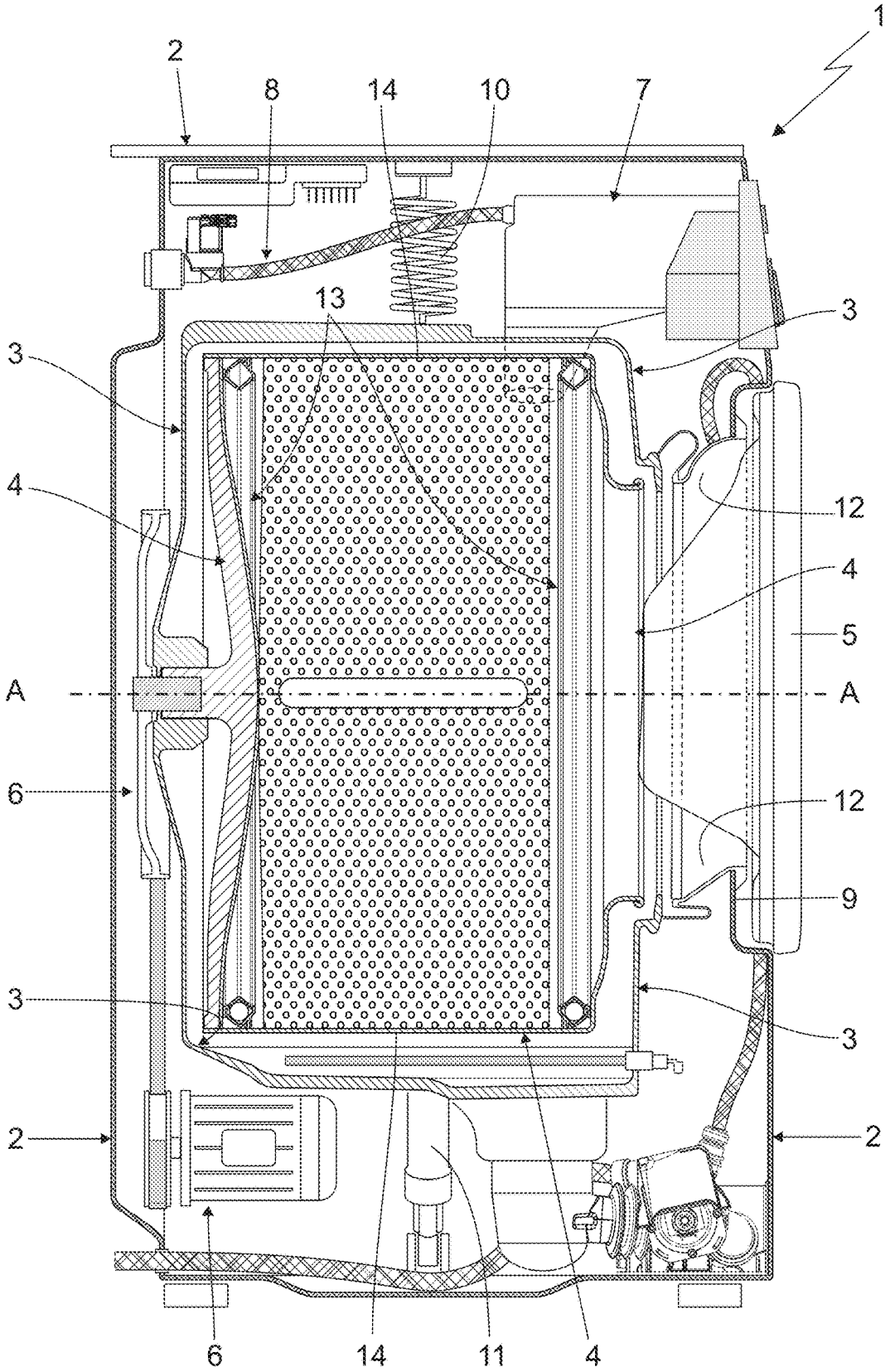
FIG. 1 is a side view of a laundry washing machine realized in accordance with the teachings of the present invention, sectioned along the midplane of the washing machine and with parts removed for clarity.
Figure 2:
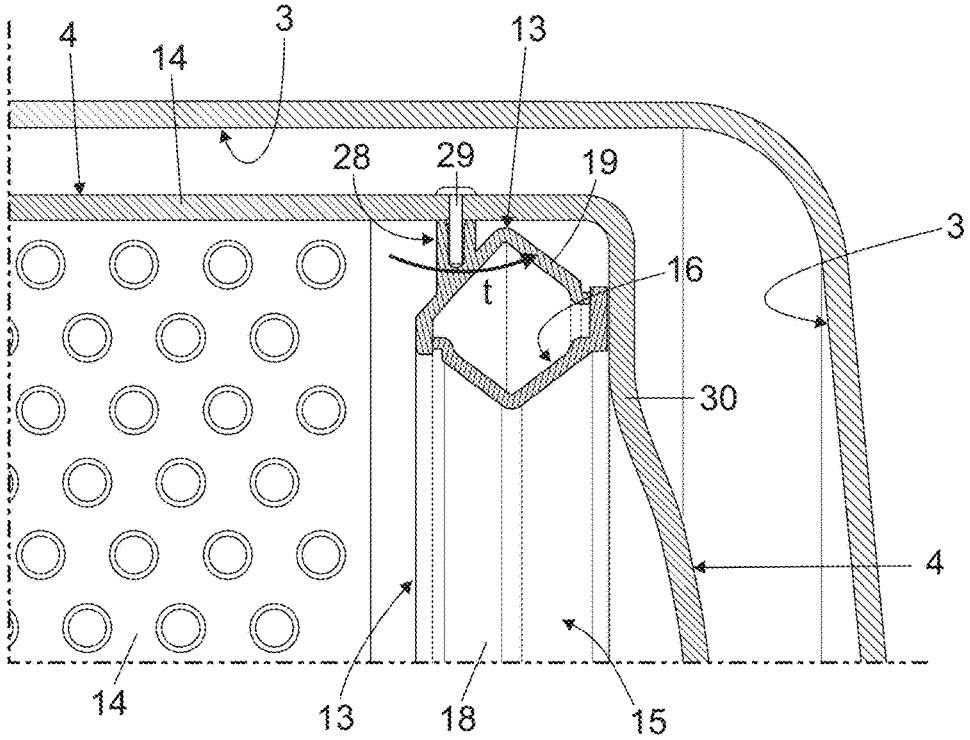
FIG. 2 is an enlarged view of part of the laundry washing machine shown in FIG. 1, with parts removed for clarity.

With reference to FIGS. 1 and 2, reference number 1 denotes as a whole a laundry washing machine 1 preferably suitable for domestic use.

The laundry washing machine 1 basically comprises: a preferably substantially parallelepiped-shaped, self-supporting boxlike outer casing 2 structured for stably resting on the floor; a preferably substantially cylindrical, washing tub 3 which, in use, contains the washing liquid and is arranged inside the casing 2 with its mouth directly facing a laundry loading-unloading opening formed on outer casing 2; a substantially cylindrical, hollow rotatable drum 4 which is structured for accommodating the laundry to be washed, and is fitted in axially rotatable manner inside the washing tub 3 so as to be able to freely rotate about its longitudinal/central axis A inside the washing tub 3; a door 5 which is hinged to the outer casing 2 so as to be manually movable to and from a closing position (see FIG. 1) in which the door 5 closes the laundry loading-unloading opening on the boxlike casing 2 for watertight sealing the washing tub 3; and an electrically-powered motor assembly 6 which is structured for driving into rotation the rotatable drum 4 about its longitudinal axis A inside the washing tub 3.

Moreover the laundry washing machine 1 comprises, inside the outer casing 2, a detergent dispenser 7 and a fresh-water supply circuit 8.

The detergent dispenser 7 is preferably located inside the outer casing 2 above the washing tub 3 and preferably, though not necessarily, immediately underneath an upper worktop or top wall of casing 2, and is structured for selectively feeding into the washing tub 3, preferably according to a washing cycle manually-selected by the user, a given amount of detergent, softener and/or other washing agent suitably mixed with water.

The fresh-water supply circuit 8, in turn, is directly connected/connectable to the water mains, and is structured for selectively channelling, preferably according to the washing cycle manually-selected by the user, a flow of water from the water mains to the detergent dispenser 7 and/or directly to the washing tub 3.

In the example shown, in particular, the washing tub 3 is preferably substantially cup-shaped, is preferably arranged substantially horizontally inside the outer casing 2, and is preferably provided with a nearly circular front mouth that directly faces a complementary-shaped, laundry loading-unloading opening formed on a front wall 9 of casing 2.

With reference to FIG. 1, the door 5, in turn, is preferably hinged to the front wall 9 so as to be manually movable, preferably about a nearly vertically-oriented rotation axis, to and from a closing position in which the door 5 closes the laundry loading-unloading opening on front wall 9 for watertight sealing the washing tub 3.

Furthermore, the washing tub 3 is preferably suspended in floating manner inside the boxlike casing 2 via a suspension system that preferably comprises at least one, and preferably a couple of coil springs 10 connecting the upper portion of washing tub 3 to the top of casing 2, and preferably at least one and more conveniently a couple of vibration dampers 11 connecting the bottom portion of washing tub 3 to the bottom of casing 2.

Preferably the laundry washing machine 1 moreover comprises an elastically-deformable tubular bellows 12 that watertight connects the front mouth of washing tub 3 to the laundry loading-unloading opening formed on the front wall 9 of boxlike casing 2.

The rotatable drum 4, on the other hand, is preferably substantially cup-shaped and is fitted in axially rotatable manner inside the washing tub 3 with its concavity facing the front mouth of washing tub 3. Preferably the rotatable drum 4 is furthermore arranged inside washing tub 3 with the drum rotation axis A locally substantially coaxial to the longitudinal axis of washing tub 3, and with its nearly circular front mouth directly aligned and faced to the front mouth of washing tub 3, so as to receive the laundry to be washed through the laundry loading-unloading opening present on front wall 9. In other words, the drum rotation axis A is preferably substantially horizontal.

Figure 3:
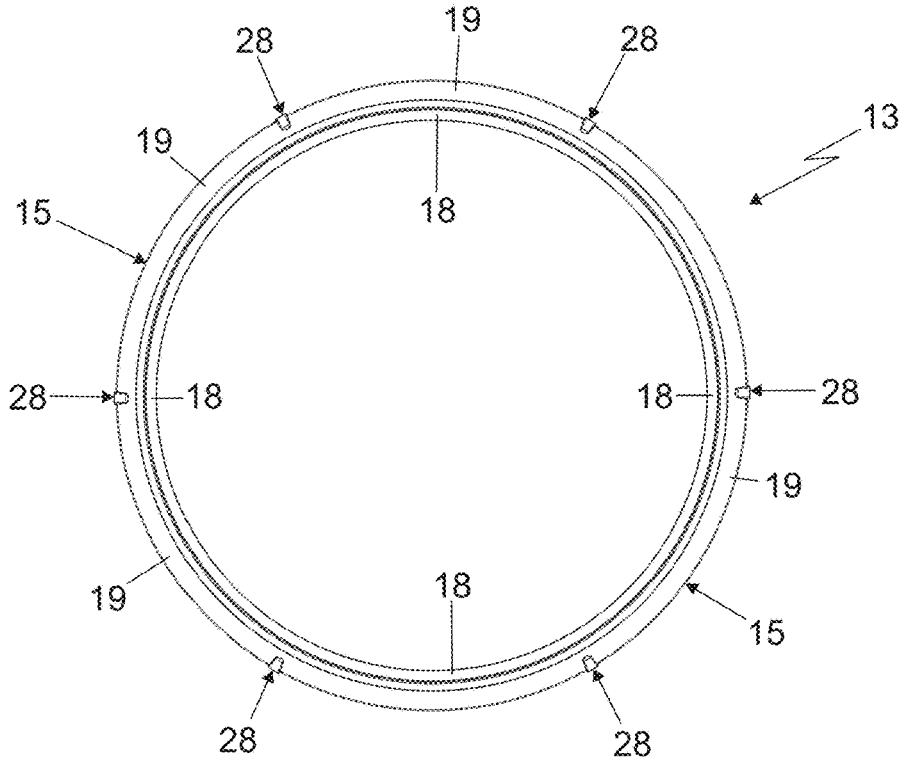
FIG. 3 is a front view of one of the balancing rings of the laundry washing machine shown in FIGS. 1 and 2.

With reference to FIGS. 1, 2 and 3, laundry washing machine 1 additionally comprises at least one balancing ring 13 which is discrete from rotatable drum 4, rigidly secured to the rotatable drum 4 substantially coaxial to the drum rotation axis A, and is adapted to minimize/reduce the vibrations produced by drum 4 when rotating at high speed about the rotation axis A while accommodating an unbalance load of laundry.

More in detail, the/each balancing ring 13 is substantially circular in shaped, and is preferably accommodated inside of drum 4 coaxial to drum rotation axis A. Preferably the/each balancing ring 13 is furthermore rigidly secured directly to the cylindrical wall 14 of drum 4.

In the example shown, in particular, laundry washing machine 1 is preferably provided with two balancing rings 13 which are rigidly secured to the body of rotatable drum 4, preferably inside the drum 4 and preferably adjacent to the front and rear rims of the cylindrical wall 14 of drum 4.

Figure 4:
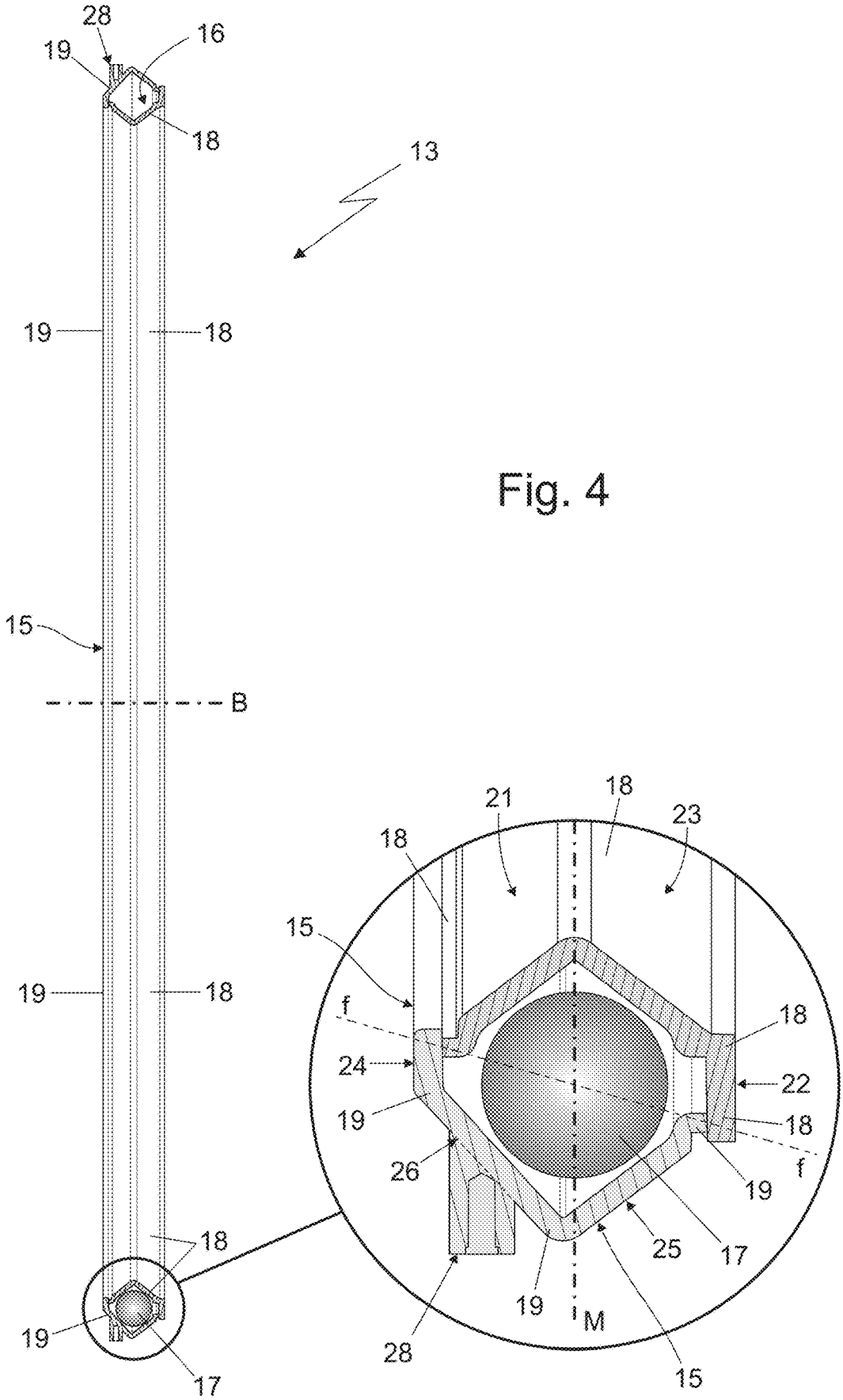
FIG. 4 is an enlarged side view of the balancing ring shown in FIG. 3, sectioned along the midplane of the washing machine.
Figure 5:
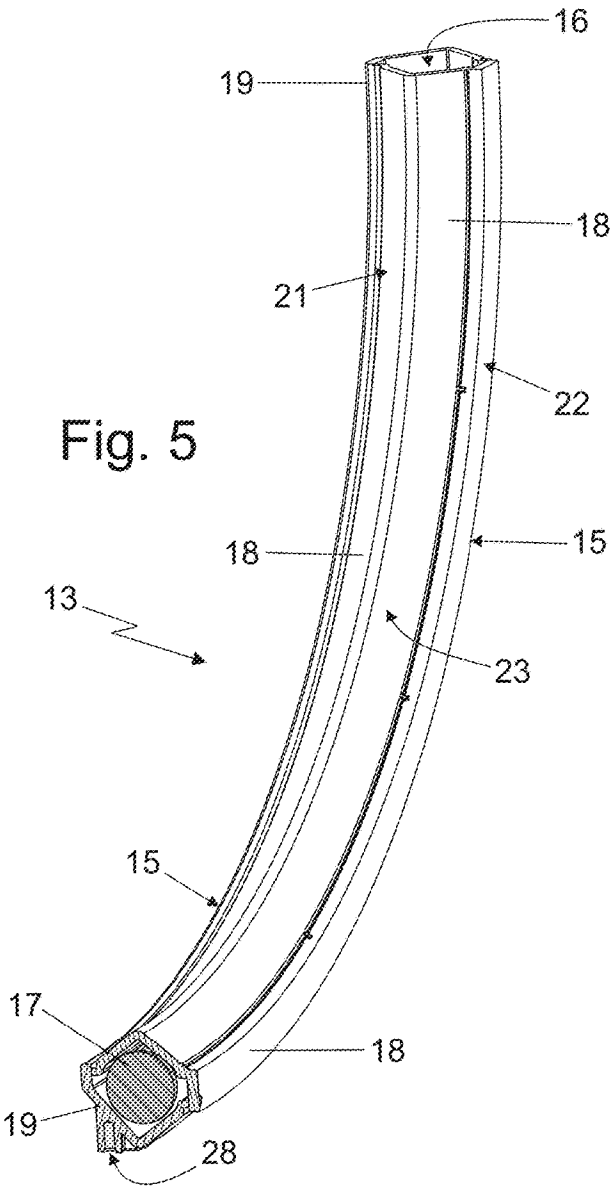

With reference to FIGS. 3, 4 and 5, the/each balancing ring 13 basically comprises: a substantially toroidal, rigid annular housing 15 which is adapted to be rigidly secured to the body of drum 4, or rather to the cylindrical wall 14 of drum 4, so that its central axis B substantially coincides with the drum rotation axis A, and has a tubular structure so as to delimit, inside itself, a closed annular cavity 16 which is circular in shape, is coaxial to central axis B and preferably has a substantially uniform cross-section; a number of heavy balancing masses 17 that are accommodated in free movable manner inside the inner cavity 16 of annular housing 15; and a dumbing liquid (not shown in the figures) that fills up, preferably completely, the inner cavity 16 of toroidal annular housing 15 for damping out the movement of the balancing masses 17 inside the annular inner cavity 16.

More in detail, the balancing masses 17 are preferably spherical in shape so as to roll on the inner surface of the hollow annular housing 15, and are preferably made of metal material. Preferably, the balancing masses 17 are moreover dimensioned so as to take up more than 50% of the transversal cross-section of inner cavity 16.

The dumbing liquid, in turn, is preferably a silicon-based liquid and/or preferably has a viscosity higher than 200 cSt (centistokes).

It is to be understood that, in toroidal geometry, a transversal cross-section of the torus is a section of the torus according to a cutting plane which extends radially from the central axis of the torus and is, at same time, perpendicular to any plane perpendicular to the central axis of the torus, whereas the midplane or equatorial plane of the torus is the plane perpendicular to the central axis of the torus and containing the geometric barycenters of all the transversal cross-sections of the torus.

With reference to FIGS. 2-6, the annular housing 15, in turn, is divided into, or at least includes, two discrete and substantially complementary annular hemishells 18 and 19 which are substantially coplanar and concentric to one another, and are watertight joined/coupled to one another so as to form/delimit the annular inner cavity 16.

More specifically, both annular hemishells 18 and 19 preferably extend astride of the midplane of the annular housing 15, (i.e. the plane perpendicular to central axis B and containing the geometric barycenters of almost all the transversal cross-sections of annular housing 15), one inside the other. Preferably the annular hemishell 19 furthermore surrounds the annular hemishell 18.

Moreover, the annular hemishells 18 and 19 have respective, approximately C-shaped transversal cross sections substantially complementary to one another, and are joined/coupled to one another along corresponding mating annular rims/edges so as to form/delimit the annular inner cavity 16 of annular housing 15.

Figure 6:
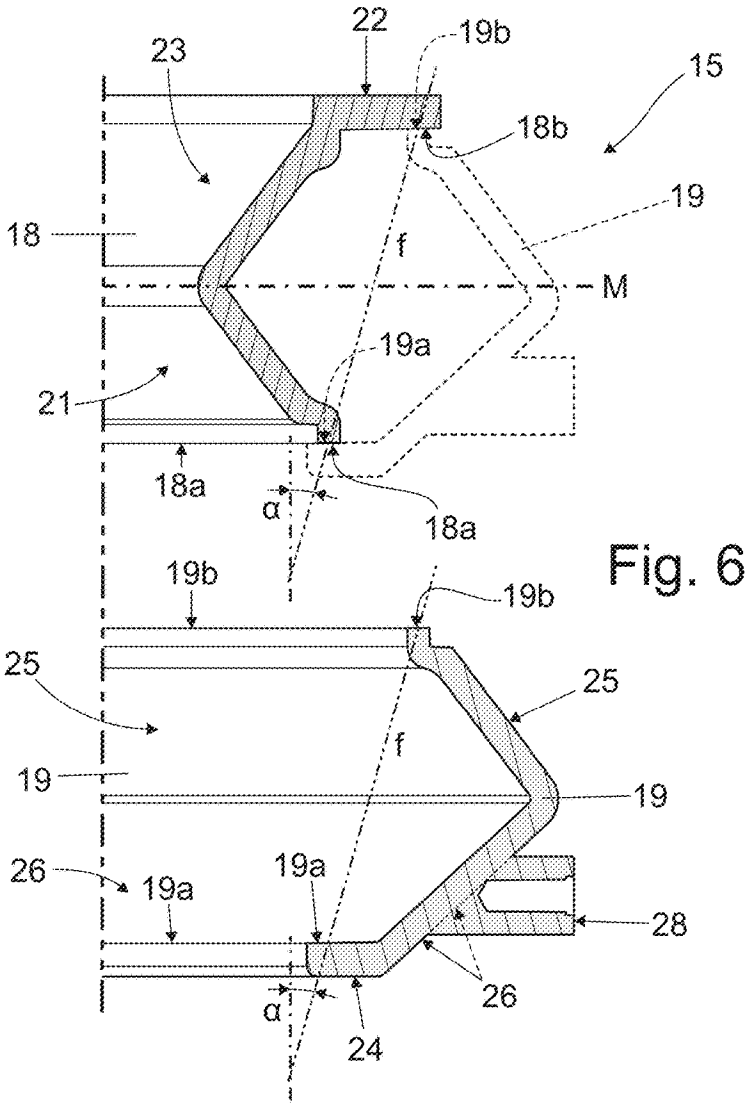
FIG. 6 is an exploded section view of part of the annular housing of the balancing ring shown in the preceding figures, with parts removed for clarity.

In addition to the above, with reference to FIGS. 2, 4 and 6, the annular hemishells 18 and 19, or rather the transversal cross-sections of annular hemishells 18 and 19, are furthermore shaped/arranged so that the aforesaid mating annular rims/edges are arranged on opposite sides of a given intermediate plane M which is substantially perpendicular to the central axis B.

In other words, the inner annular hemishell 18 has an approximately C-shaped cross section with the concavity facing the annular hemishell 19, i.e. opposite to central axis B, and the two annular rims/edges 18*a* and 18*b* delimiting the annular groove/race of hemishell 18 are located on opposite sides of said intermediate plane M.

The outer annular hemishell 19, in turn, has an approximately C-shaped cross section with the concavity facing the central axis B and the annular hemishell 18, and the two annular rims/edges 19*a* and 19*b* delimiting the annular groove/race of hemishell 19 are located on opposite sides of said intermediate plane M. The outer annular hemishell 19, furthermore, encircles the inner annular hemishell 18 so that its two annular rims/edges 19*a* and 19*b* area aligned and stably coupled/joined each to a respective facing annular rim/edge 18*a*, 18*b* of annular hemishell 18.

Preferably the intermediate plane M moreover substantially coincides with the midplane of annular housing 15.

In addition to the above, with reference to FIGS. 2, 4, 5 and 6, the annular hemishells 18 and 19 are preferably shaped so that the two annular rims/edges 18*a* and 18*b* of the inner annular hemishell 18 and the two annular rims/edges 19*a* and 19*b* of the outer annular hemishell 19 are located/extend/lie on a same/common frustoconical surface which is coaxial to the central axis B of annular housing 15 and has an opening angle lower than 150°.

More in detail, the opening angle of said frustoconical surface preferably ranges between 20° and 70°. In other words, the generatrix f of the frustoconical surface makes an angle $\alpha$ with respect to central axis B preferably ranging between 10° and 35°.

In the example shown, in particular, the annular rims/edges 18*a*, 18*b*, 19*a* and 19*b* of the annular hemishells 18 and 19 are located/extend/lie on a frustoconical surface whose generatrix f is preferably inclined with respect to central axis B by an angle $\alpha$ roughly equal to 15°.

In other words, the opening angle of the frustoconical surface on which the annular rims/edges 18*a*, 18*b*, 19*a* and 19*b* of annular hemishells 18 and 19 lie is preferably equal to roughly 30°.

In addition to the above, the annular hemishells 18 and 19 are preferably made of plastic material and are stably fused/joined to one another preferably via vibration welding.

Therefore, the two annular rims/edges 18*a* and 18*b* of inner annular hemishell 18 are stably joined/fused to the corresponding mating annular rims/edges 19*a* and 19*b* of outer annular hemishell 19 preferably by vibration welding.

According to an alternative embodiment, however, the two annular rims/edges 18*a* and 18*b* of inner annular hemishell 18 may be stably joined to the mating annular rims/edges 19*a* and 19*b* of outer annular hemishell 19 by gluing.

With reference to FIGS. 2, 4, 5 and 6, preferably the inner and outer annular hemishells 18 and 19 are furthermore shaped/structured so as to form/delimit an annular inner cavity 16 having a substantially polygonal-shaped cross section.

In other words, the approximately C-shaped cross section of both annular hemishells 18 and 19 has a curved polygonal-chain profile, i.e. a series of straight line segments connected and inclined to one another.

In the example shown, in particular, the inner and outer annular hemishells 18 and 19 are preferably shaped so as to form/delimit an annular inner cavity 16 having a nearly hexagonal cross section.

More specifically, the inner annular hemishell 18 is preferably provided with a first wall segment 21 and a second wall segment 22 nearly faced and non-parallel to one another, and a third wall segment 23 connecting the first wall segment 21 to the second wall segment 22.

The first annular rim/edge 18*a* of annular hemishell 18 edges the first wall segment 21 of annular hemishell 18, whereas the second annular rim/edge 18*b* of annular hemishell 18 edges the second wall segment 22 of annular hemishell 18.

Similarly, the outer annular hemishell 19 is preferably provided with a first wall segment 24 and a second wall segment 25 nearly faced and non-parallel to one another, and a third wall segment 26 connecting the first wall segment 24 to the second wall segment 25.

The first annular rim/edge 19*a* of annular hemishell 19 edges the first wall segment 24 of annular hemishell 19, whereas the second annular rim/edge 19*b* of annular hemishell 19 edges the second wall segment 25 of annular hemishell 19.

Moreover, the first wall segment 24 of outer annular hemishell 19 is preferably faced to the second wall segment 22 of inner annular hemishell 18. The second wall segment 25 of outer annular hemishell 19 is preferably faced to the first wall segment 21 of inner annular hemishell 18. The first wall segment 24 of outer annular hemishell 19 is furthermore faced to the second wall segment 22 of inner annular hemishell 18.

With reference to FIGS. 2-6, preferably the outer annular hemishell 19 of annular housing 15 is finally structured to firmly rest/prop on the body of drum 4, or rather against the cylindrical wall 14 of drum 4, coaxial to drum rotation axis A.

More in detail, the outer annular hemishell 19 is preferably provided with a number of fixing protrusions 28 which are angularly spaced about the central axis B and extend outwards in a nearly radial direction so as to stably abut against the body of drum 4, or rather against the cylindrical wall 14 of drum 4.

Preferably, these fixing protrusions 28 are additionally coplanar to one another and substantially regularly spaced about the central axis B.

In the example shown, in particular, the fixing protrusions 28 are preferably regularly spaced about the central axis B and extend on a same/common reference laying plane which is substantially parallel to and offset from the intermediate plane M, or rather offset from the midplane of annular housing 15.

With particular reference to FIGS. 2, 4 and 6, preferably each fixing protrusion 28 is finally adapted to be engaged by a preferably radially-extending, fixing screw 29 that extend in pass-through manner through the body of drum 4, or rather through the cylindrical wall 14 of drum 4.

More in detail, each fixing protrusion 28 is preferably provided with a radially-oriented, bling central hole adapted to be engaged by the threaded stem of the fixing screw.

Operation of laundry washing machine 1 is almost identical to that of any other laundry washing machine and therefore does not require further explanations.

As regards the balancing rings 13, during spin phases, the balancing masses 17 tend to group together and to move inside the annular inner cavity 16 of annular housing 15 so as to balance the unbalanced load (laundry) momentarily placed inside the drum 4.

The advantages resulting from the particular structure of balancing ring 13 are large in number.

First of all, in balancing ring 13, the balancing masses 17 roll nearly astride the centreline of annular hemishell 19 thus minimizing the mechanical stresses to the welding lines/areas of annular housing 15, i.e. the annular rims/edges 18*a*, 18*b*, 19*a* and 19*b* of annular hemishells 18 and 19. Therefore the balancing ring 13 can easily withstand drum rotation speeds significantly higher than 1000 rpm without long-term structural problems.

Moreover each balancing mass 17 has now two spaced points of contact with the surface of annular hemishell 19, thus reducing the noise of the balancing masses 17 rolling inside the inner annular cavity 16.

In addition to the above, with reference to FIG. 2, the particular arrangement of the fixing protrusions 28 on a common laying plane slightly offset with respect to the intermediate plane M on which the barycenters of the balancing masses 17 moves during spin phases, in use causes transversal forces t in the transversal plane that may bend the fixing protrusions 28.

If the inner annular hemishell 18 rests in abutment against the front wall 30 of drum 4 and the outer annular hemishell 19 rests in abutment against the cylindrical wall 14 of drum 4, these transversal forces t are allowed to press the two annular hemishells 18 and 19 one against the other, thus significantly reducing the mechanical stresses on the welding lines/areas of annular housing 15.

Finally, the particular shape/profile of the cross sections of annular hemishells 18 and 19 allows to produce a significantly stiffener toroidal annular housing 15 and moreover highly simplifies the assembly process of the balancing ring 13 with the cost savings that this entails.

Clearly changes and modifications may be made to laundry washing machine 1 and to balancing ring 13 without, however, departing from the scope of the present invention.

For example, in a less sophisticated embodiment the balancing ring 13 may lack the dumbing liquid.

Moreover, the balancing ring or rings 13 may be firmly secured to the body of drum 4, outside of drum 4.

Furthermore, the front balancing ring 13 may be located/recessed into an specific annular seat formed in the front wall 30 of drum 4, obviously coaxial to drum longitudinal axis A.

Lastly, the fixing protrusions 28 may be replaced by a single outwards-protruding annular rib or ridge extending all around the annular hemishell 19.

The invention claimed is:

1. A laundry washing machine, comprising:

an outer casing;

a washing tub inside the outer casing and configured to contain a washing liquid;

a drum fitted in an axially rotatable manner inside the washing tub and configured to contain laundry to be washed; and at least one balancing ring rigidly secured to the drum and configured to reduce vibrations generated during rotation of the drum, the at least one balancing ring comprising:

a toroidal annular housing rigidly secured to the drum and comprising a first annular hemishell and a second annular hemishell, the first annular hemishell and the second annular hemishell being discrete parts that are joined together to form a closed annular inner cavity, and a number of balancing masses accommodated in free movable manner inside the annular inner cavity, wherein the first annular hemishell and the second annular hemishell are concentric to one another, have C-shaped cross sections that are complementary to one another, are joined to one another along respective first and second mating annular rims located on opposite sides of an intermediate plane (M) perpendicular to a central axis of the annular housing, and are non-parallel to the intermediate plane (M), wherein the second annular hemishell includes a plurality of fixing protrusions angularly spaced about the central axis of the annular housing and surrounds the first annular hemishell, and wherein the second annular hemishell is configured to firmly abut on the drum.

2. The laundry washing machine according to claim 1, wherein the respective first annular rim and the respective second annular rim of the first annular hemishell and the respective first annular rim and the respective second annular rim of the second annular hemishell are located along a frustoconical surface (f) that is coaxial to the central axis (B) of the annular housing, and has an opening angle lower than 150°.

3. The laundry washing machine according to claim 2, wherein the opening angle of the frustoconical surface (f) is between 20° and 70°.

4. The laundry washing machine according to claim 3, wherein the opening angle of the frustoconical surface (f) is equal to about 30°.

5. The laundry washing machine according to claim 1, wherein the respective C-shaped cross sections of both the first annular hemishell and the second annular hemishell each has a curved polygonal-chain profile, so that the annular inner cavity has a polygonal-shaped cross section.

6. The laundry washing machine according to claim 5, wherein the annular inner cavity has an hexagonal cross section.

7. The laundry washing machine according to claim 6, wherein:

the first annular hemishell has a respective first wall segment, a respective second wall segment facing and non-parallel to the first wall segment, and a respective third wall segment connecting the first wall segment to the second wall segment;

the respective first annular rim of the first annular hemishell is at an edge of the first wall segment of the first annular hemishell; and the second annular rim of the first annular hemishell is at an edge of the second wall segment of the first annular hemishell.

8. The laundry washing machine according to claim 7, wherein:

the second annular hemishell has a respective first wall segment, a respective second wall segment facing and non-parallel to the first wall segment, and a respective third wall segment connecting the first wall segment to the second wall segment;

the respective first annular rim of the second annular hemishell is at an edge of the first wall segment of the second annular hemishell; and the second annular rim of the second annular hemishell is at an edge of the second wall segment of the second annular hemishell.

9. The laundry washing machine according to claim 1, wherein the first annular hemishell and the second annular hemishell are made of plastic material.

10. The laundry washing machine according to claim 9, wherein the first annular rim and the second annular rim of the first annular hemishell are welded to a corresponding one of the first annular rim and the second annular rim of the second annular hemishell.

11. The laundry washing machine according to claim 1, wherein the balancing ring includes, inside the annular inner cavity, a damping liquid configured to damp a movement of the balancing masses inside the annular inner cavity.

12. The laundry washing machine according to claim 1, wherein the balancing masses are spherical.

13. The laundry washing machine according to claim 1, wherein the intermediate plane (M) coincides with a midplane of the annular housing.

14. The laundry washing machine according to claim 1, wherein each of the first annular hemishell and the second annular hemishell extends astride a midplane of the annular housing.

* * * * *